United States Patent [19]

Gerstenberg

[11] 4,294,414

[45] Oct. 13, 1981

[54] FEED ROLL DEVICE FOR SHEET GRANULATOR

[75] Inventor: Roy W. Gerstenberg, Norfolk, Mass.

[73] Assignee: Leesona Corporation, Warwick, R.I.

[21] Appl. No.: 112,075

[22] Filed: Jan. 14, 1980

[51] Int. Cl.[3] ..... B02C 18/22; B02C 18/44

[52] U.S. Cl. ..... 241/222; 271/188

[58] Field of Search ..... 241/3, 101.4, 221, 222; 271/188

[56] References Cited

U.S. PATENT DOCUMENTS

| | | | |
|---|---|---|---|
| 2,843,377 | 7/1958 | Battersby | 271/188 |
| 2,890,840 | 6/1959 | Fletcher et al. | 241/222 UX |
| 3,550,935 | 12/1970 | Smith et al. | 271/188 |
| 3,960,334 | 6/1976 | Wudyea | 241/222 X |
| 4,028,779 | 6/1977 | Shah | 241/222 X |
| 4,176,796 | 12/1979 | Barnes et al. | 241/222 X |

*Primary Examiner*—Howard N. Goldberg

*Attorney, Agent, or Firm*—Robert J. Doherty

[57] ABSTRACT

A device for feeding sheet material into a granulator and particularly scrap plastic sheet material of the type wherein a plurality of such sheets are normally twisted together to form a composite rope which is fed between opposed feed rolls and subsequently into a granulation chamber. The present feed device includes a pair of cooperating rolls, each of which is provided with a plurality of longitudinally spaced, radially inwardly extending grooves. The grooves of each roll are adapted to mesh or interdigitate with a resultantly formed ridge on the opposing roll such that the sheet material fed therebetween is forced into a sinuous cross sectional configuration and subjected to differing roll surface velocities. Both of the above-described conditions imparted to the sheet material are believed to contribute to trouble free positive feeding especially when feeding individual, i.e. single sheet material thicknesses.

6 Claims, 4 Drawing Figures

FEED ROLL DEVICE FOR SHEET GRANULATOR

BACKGROUND AND SUMMARY OF THE INVENTION

This invention relates to a granulator and especially to an improved sheet feeding apparatus associated therewith so as to accomplish improved operations as will hereinafter be indicated. In order to reprocess waste or off-specification plastic sheet material, it is known to granulate such for subsequent ease in transporting, melting and the like. In order to accomplish such, it is necessary that the sheet material be positively fed to the granulation chamber, preferably in a continuous manner and trouble free.

In processing sheet material such as the edge trim from extruded plastic sheet, it is normal to twist or otherwise bunch several such trim ribbons together into a longitudinally extending rope which is thereafter directed to the nip of a pair of opposed driven feed rolls. Feed rolls of this general type are known and include those described in U.S. Pat. No. 4,028,779 issued June 14, 1978 and U.S. Pat. No. 4,176,796 issued Dec. 4, 1979. Both of such aforementioned patents are directed to inventions other than the construction of such feed rolls and the means for driving such per se but disclose roll constructions which can be utilized to feed such roped sheet. Such edge trim is normally about 3 inches wide as for a 3 or 4 foot wide sheet; however, various other widths can be utilized. Various thicknesses may be assumed dependent on that of the sheet material extruded. Generally, however, the thicknesses of material which the present invention deals with are on the order of several thousandths of an inch thick, i.e. from about 0.001 inches to about 0.05 inches. Such films are not self-supporting and accordingly present considerable problem in feeding and thus require some mechanism of grouping or plying multiple ribbons together as in forming the above-described roping. Thus, extremely thin, flexible and generally non-self-supporting film ribbons can generally be satisfactorily fed to granulation equipment by such above-discussed feed roll constructions since the necessary thickness to insure proper feed is achieved by such twisting or roping of the various sheets which individually would otherwise present a difficult feed task. However, since the length of such individual ribbons is generally not equal, one or more of such ribbons often play out in the overall rope construction at various positions along the length of the rope and accordingly an inadequate sheet thickness, e.g. a single sheet of material, is occasionally presented to the feed rolls which can and often does present a feed problem, i.e. slippage or roll wrap. In either event, the feed is undesirably stopped and thus requires appropriate operator attention.

It is accordingly an object of the present invention to provide a feed roll apparatus of improved construction so as to avoid the aforementioned drawbacks. These and other objects of the invention are accomplished by the provision of a sheet material feed drive for operation with a granulator having a rotor mounted for rotation about an axis within a granulation chamber. Such feeding device comprises first and second longitudinally oriented, generally cylindrical feed rolls coaxially mounted with respect to each other so as to form a longitudinally directed nip for receipt of a minimum thickness of at least a single material sheet therebetween and a maximum thickness of a plurality of said sheets.

The rolls each include a plurality of radial grooves inwardly extending a distance slightly greater than said maximum material thickness and longitudinally spaced from each other so as to form a plurality of spaced ridges adjacent said grooves and wherein said rolls are longitudinally positioned with respect to each other so that the ridges of one of the rolls and the grooves of the other rolls and vice versa are aligned for respective interdigitation. Such roll construction forces sheet material fed to the nip thereof into a sinuous cross-sectional configuration and imparts different frictional surface velocities to opposite surfaces thereof.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
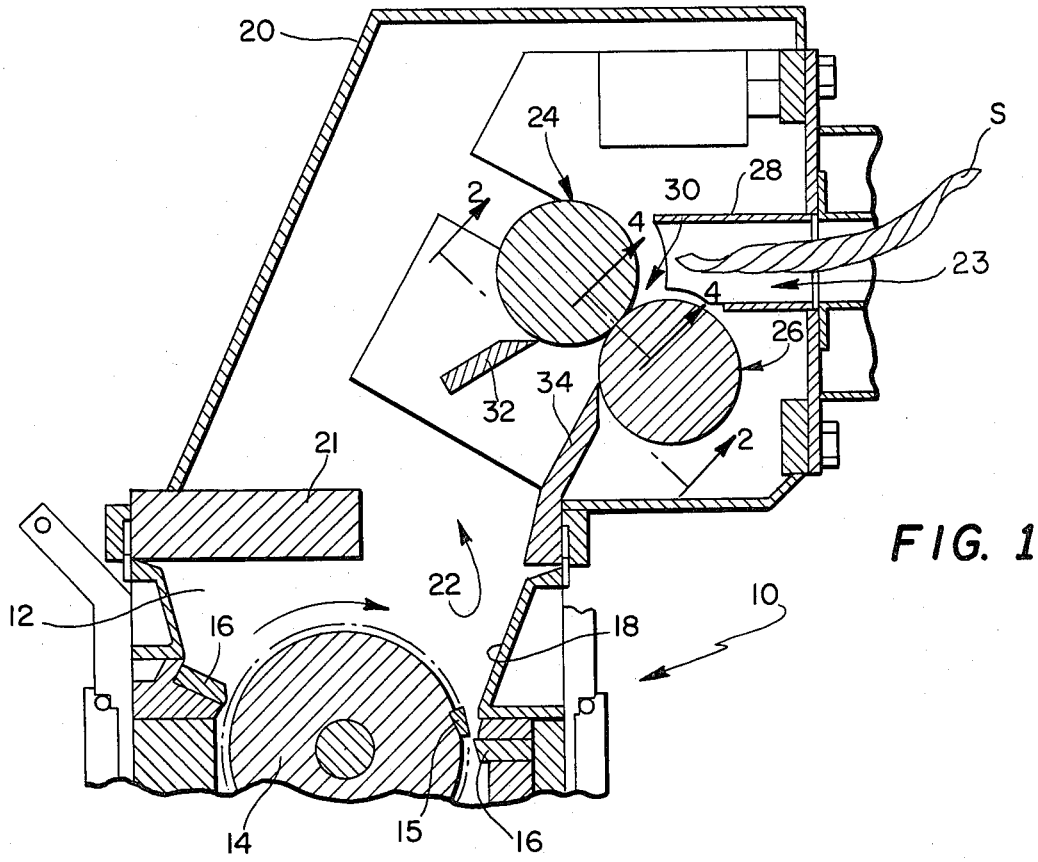
FIG. 1 is a cross-sectional elevational view of a portion of a sheet granulator and in particular showing the construction of the feed apparatus therefor.

Turning now to the drawing, FIG. 1 shows the construction of the present invention in a somewhat schematic form. Accordingly, a granulator 10 of the type having a chamber 12 in which a rotor 14 is rotationally mounted is depicted. The rotor includes a plurality of knives 15 (one of which is shown) outwardly projecting from the periphery thereof. The rotor is axially, i.e. longitudinally mounted for rotation in the direction of the arrow wherein the knives are positioned for cooperating cutting relationship with one or more fixed position bed knives 16. Although several such bed knives may be cooperatively mounted, at least one thereof is mounted so as to project into the chamber from the portion of a chamber wall 18 preferably on at least on the downstroke side thereof. The lower part of the chamber 12 includes a screen (not shown) having openings of a predetermined size of the material fed into the chamber and comminuted by the cooperative action of the above-described knives will, once having been reduced to such predetermined size, pass through the openings therein and accordingly discharge from the chamber for further processing including such procedures as blending remelting and the like.

The granulator includes a housing 20 mounted on the top thereof in such a fashion that interior portions of the housing are in communication with the chamber 12 although such communication may be partially restricted by providing a chamber top 21 so as to define an entrance slot or opening 22 therebetween. The housing further includes a feed opening 23 through which sheet material S may be fed into the chamber 12 by a pair of feed rolls including an upper feed roll 24 and a lower feed roll 26. Either or both of the rolls, 24, 26 may be positively driven by means of any suitable driven mechanism including contact rolls and belt systems and including those described in the aforementioned patents, namely U.S. Pat. Nos. 4,028,779 and 4,176,796 the disclosures of which are hereby specifically incorporated into the present disclosure.

An appropriate feed chute or guide housing 28 may be incorporated in communication with the feed opening 23 in order to insure the proper initial direction of the sheet material into the nip 30 of the cooperating rollers 24, 26. In addition, stripper bars 32 and 34 respectively adapted for cooperation with the rolls 24 and 26 respectively may be provided. The longitudinal configuration of such stripper bars is crenulated so as to conform with the longitudinal cross-sectional configuration of each of the feed rolls 24, 26 as will further hereinafter be explained and the bars may be suitably supported for operational contact with the rolls 24, 26.

The rolls 24,26 are both generally cylindrical and each are provided with a plurality of longitudinally spaced, radially inwardly extending grooves 36 which in effect form adjacent ridges 38. The depth of such grooves 36 is slightly greater than the maximum thickness of sheet material anticipated to be processed between the rolls 24, 26, that is, the thickness of the sheet material to be fed between the rolls will range from a minimum thickness of at least a single material sheet and a maximum thickness of a plurality of such sheets whether such plurality is twisted, roped or otherwise configured. In dealing with a practical range of plastic sheet materials, including polyethelene, PVC and polyester materials, sheet thicknesses in the range of about 0.001 inch to 0.05 inches are generally encountered. For such materials, a groove depth of between about 1/16 and $\frac{1}{8}$ inch in height was found to give the desired positive drive results. In one specific embodiment, the diameter of each roll was $2\frac{5}{8}$ inches while the diameter of the grooves thereof was $2\frac{3}{8}$ inches in diameter.

The rolls 24, 26 are disposed in opposite relation to one another such that the ridges 38 of the roll 24 are adapted to partially extend into each of the grooves **36*a* present in the roll 26 so as to form, in effect, groove-ridge pairs. In each case, it is preferable that the groove and ridge of each such pair be generally centered with respect to each other, that is, that the longitudinal side to side clearance between the adjacent ridge sidewall 42 and groove sidewalls 44 be greater than the maximum anticipated material of sheet thickness such that there is no noticeable pinch effected on the sheet material S by the cooperation of such surfaces 42 and 44**. In this regard, a controlled spacing is effected between the rolls as by known devices.

Figure 2:
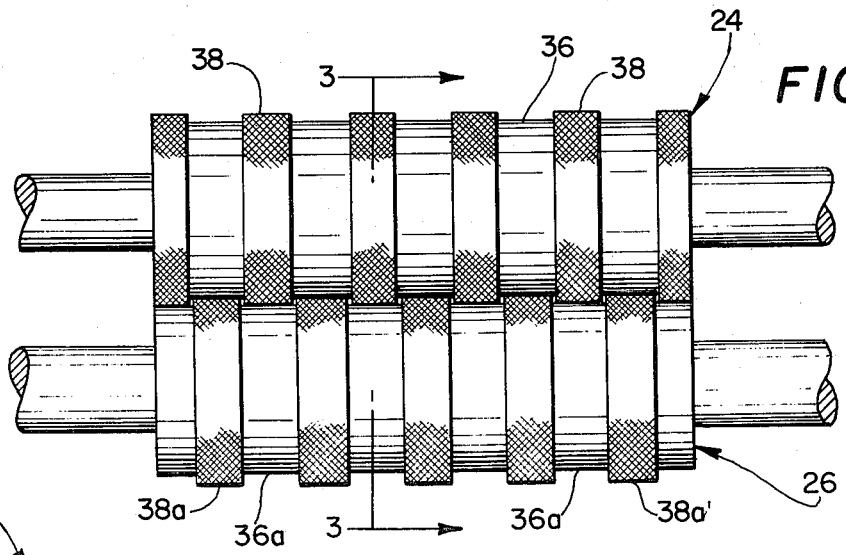
FIG. 2 is an elevational view taken along the line 2—2 of FIG. 1.
Figure 3:
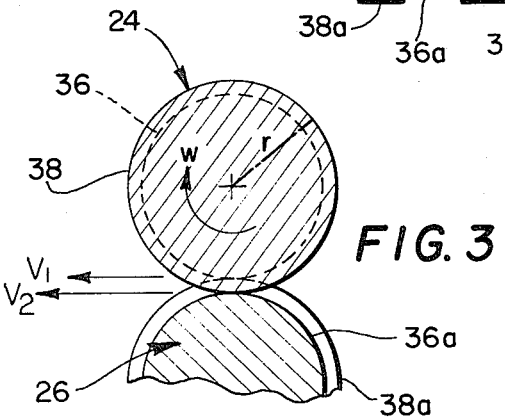
FIG. 3 is a cross-sectional view of one of the rolls taken along the line 3—3 of FIG. 2.
Figure 4:
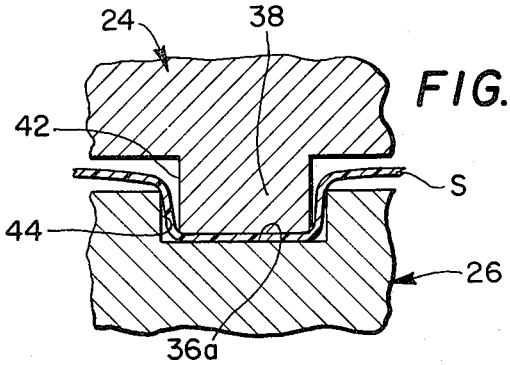
FIG. 4 is an enlarged cross-sectional view of a portion of said rolls taken along the line 4—4 of FIG. 1.

It will be noticed, especially from reference to FIGS. 2 and 4 that the sheet material S is forced to assume a somewhat sinuous cross-sectional configuration as it moves through the nip 30 between the rolls 24, 26. In addition, and as best shown in FIGS. 3 and 4, one surface of the sheet material S, i.e. the lower surface is adapted to engage the upper surface of the groove 36 while the opposite or uppper surface portion of such sheet segment is adapted to contact the outer surface of the ridge **38*a* of the cooperating groove-ridge pair shown. In addition, it should be noted that the outer surface of the ridges 38 of the roll by reason of their greater radial projection, move at a relatively greater surface or pitch line velocity than the outer surface of the adjacent grooves 36** of such roll. In other words, the ridge velocity $V_2$ is greater than the groove velocity $V_1$ for any given rotation of a roll (velocity = roll rotation speed times radius). Subjecting the opposite surface portions of the sheet S to such relative velocities tends to frictionally impart (by sheet to roll surface contact) relative differing resultant speeds to different portions of the sheet so as to insure a positive feed thereof.

Such frictional effect is to some extent increased by preferably providing the outer surfaces of both the ridges 38 and **38*a* with a rather fine overall knurl. The particular type of a knurl is not believed to be critical. In the specific dimensional embodiment above referred to, a number 8228 fine knurl was provided over all on the outer surface of each of the ridges 38 and 38*a***. It was found that such knurl in some instances produced a minimal piercing of the material especially when a single sheet was present between the rolls. Such piercing or roughened effect imparted to the film surface did not seem to materially effect the positive drive through the rolls either adversely or beneficially.

While there is shown and described therein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination with a granulator for size reduction of plastic sheet material, a feeding device for feeding such sheet material thereto, said granulator including walls defining a generally enclosed chamber, a rotor mounted for rotation about an axis within said chamber, cutting means affixed on said rotor, bed knife means mounted for projection into said chamber for cooperative cutting relationship with said rotor cutting means as said rotor is driven, said feeding device comprising first and second longitudinally oriented, generally cylindrical feed rolls coaxially mounted with respect to each other so as to form a longitudinally directed nip for receipt of a minimum thickness of at least a single material sheet therebetween and a maximum thickness of a plurality of said sheets, means for continuously rotating said rolls in opposite rotational directions, means for positioning said rolls in spaced relation with each other and means for directing said sheet material to said nip whereby said rolls feed said material to said chamber for granulation therein, the outer surface of both said rolls having a plurality of radial grooves inwardly extending a distance slightly greater than said maximum material thickness, said grooves longitudinally spaced from each other along each said rolls so as to form a plurality of spaced ridges adjacent said grooves, said rolls longitudinally positioned with respect to each other so that the ridges of said first roll and the grooves of said second roll and vice versa are aligned for respective interdigitation with each other such that said sheet material passing through said nip is forced into a sinuous cross-sectional configuration by said interdigitation of said rolls and whereby opposite surfaces portion of said sheet material are contacted by respective roll surfaces at different surface velocities.

2. The granulator construction of claim 1, each of said roll grooves forming a groove-ridge pair with that ridge of the opposite roll adapted to extend thereinto, each of said grooves being of a longitudinally extending width greater by least twice maximum thickness of said sheet material than that of the ridge of said groove-ridge pair of said opposed groove-ridge pairs generally longitudinally centered with respect to each other.

3. The granulator construction of claim 2, said ridges of each roll including an overall evenly knurled surface.

4. The granulator construction of claim 3, said grooves each of a depth of between 1/16" and $\frac{1}{8}$".

5. The granulator construction of claim 2, said grooves each of a depth of between about 1/16" and $\frac{1}{8}$".

6. The granulator construction of claim 1, said ridges of each roll including an overall evenly knurled surface.

* * * * *